US006302271B1

(12) United States Patent
Grant

(10) Patent No.: US 6,302,271 B1
(45) Date of Patent: Oct. 16, 2001

(54) PROTECTIVE SHIPPING CONTAINER FOR FLOWERS

(76) Inventor: Selwyn E. Grant, 2612 S. Beverly Dr., Los Angeles, CA (US) 90034-1816

( * ) Notice: Subject to any disclaimer, the term of this patent is extended or adjusted under 35 U.S.C. 154(b) by 0 days.

(21) Appl. No.: 09/528,531

(22) Filed: Mar. 20, 2000

Related U.S. Application Data

(63) Continuation-in-part of application No. 09/272,187, filed on Mar. 18, 1999, now Pat. No. 6,039,180.

(51) Int. Cl.[7] ..... B65D 85/50; B65D 6/28

(52) U.S. Cl. ..... 206/423; 47/84; 206/509; 220/4.24

(58) Field of Search ..... 206/423, 503, 206/509; 47/41.01, 41.11, 73, 84; D11/143, 144, 146, 147, 155; 220/23.6, 4.21–4.24

(56) References Cited

U.S. PATENT DOCUMENTS

| | | | | |
|---|---|---|---|---|
| 536,908 | * | 4/1895 | Bailey | 206/423 |
| 580,424 | * | 4/1897 | Pierson | 206/423 |
| 1,064,813 | * | 6/1913 | Bloomberg | 206/423 |
| 2,087,259 | * | 7/1937 | Mortensen | 206/423 |
| 2,487,168 | * | 11/1949 | Mordkin | 206/509 X |
| 3,678,620 | * | 7/1972 | Voges | 206/423 X |
| 4,113,094 | * | 9/1978 | Collin | 206/423 |
| 4,840,275 | * | 6/1989 | Faiola et al. | 206/423 |
| 5,217,117 | * | 6/1993 | Tsuji | 206/423 |
| 5,356,023 | * | 10/1994 | Koupa | 206/4.24 |
| 6,039,180 | * | 3/2000 | Grant | 206/423 |

FOREIGN PATENT DOCUMENTS

| | | | | |
|---|---|---|---|---|
| 715219 | * | 9/1959 | (GB) | 206/423 |
| 267180 | * | 10/1989 | (JP) | 206/423 |

* cited by examiner

*Primary Examiner*—Bryon P. Gehman
(74) *Attorney, Agent, or Firm*—Fulwider Patton Lee & Utecht, LLP

(57) ABSTRACT

A closeable shipping container for containment of a plurality of flowers with stems which includes separated protective bud-containing housings and/or separate stem supporting notched bridging or supporting members. The container is made of plastic, or other lightweight, but strong materials. The container is dimensioned so that the volume it occupies, per dozen flowers, is most economical to ship.

6 Claims, 6 Drawing Sheets

FIG. 2
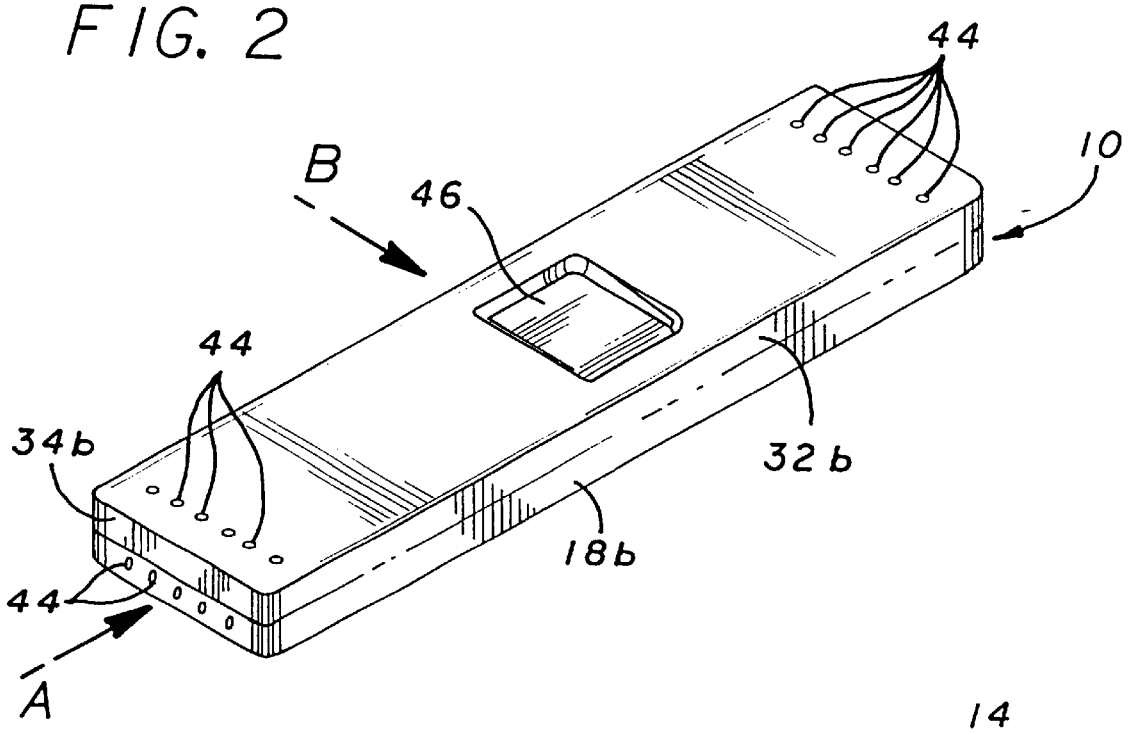
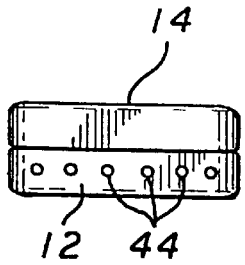
FIG. 3
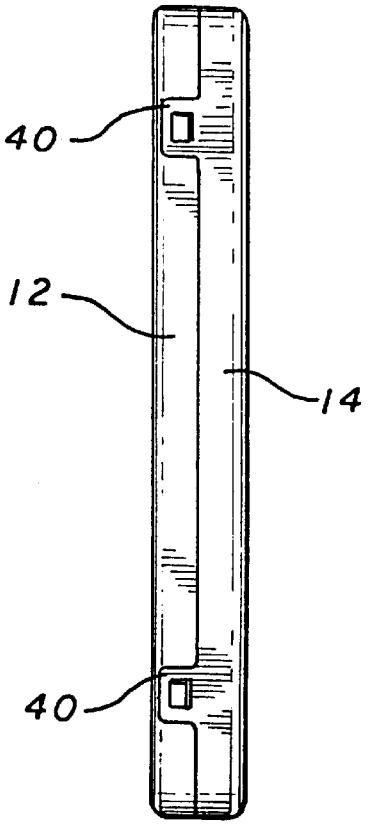
FIG. 4

FIG. 7
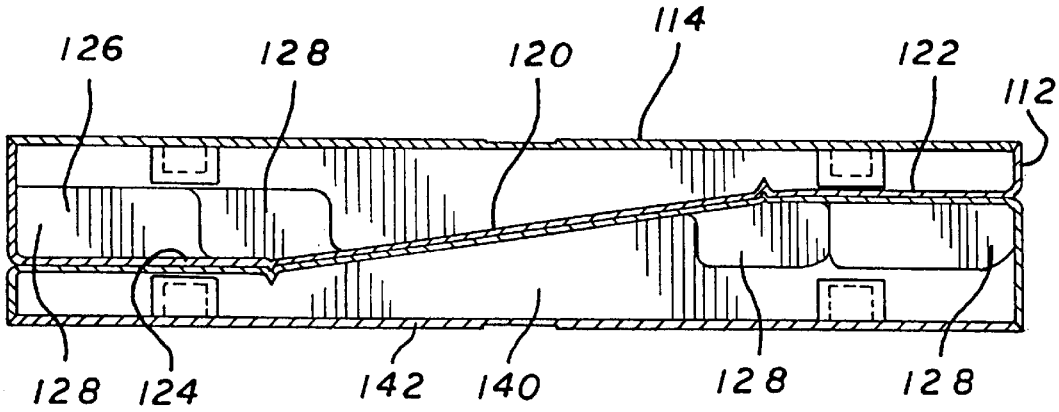
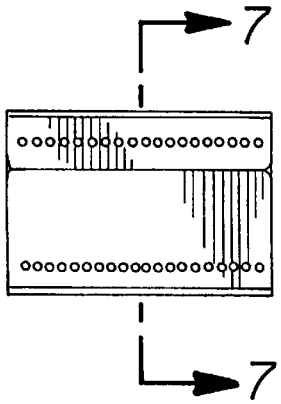
FIG. 6
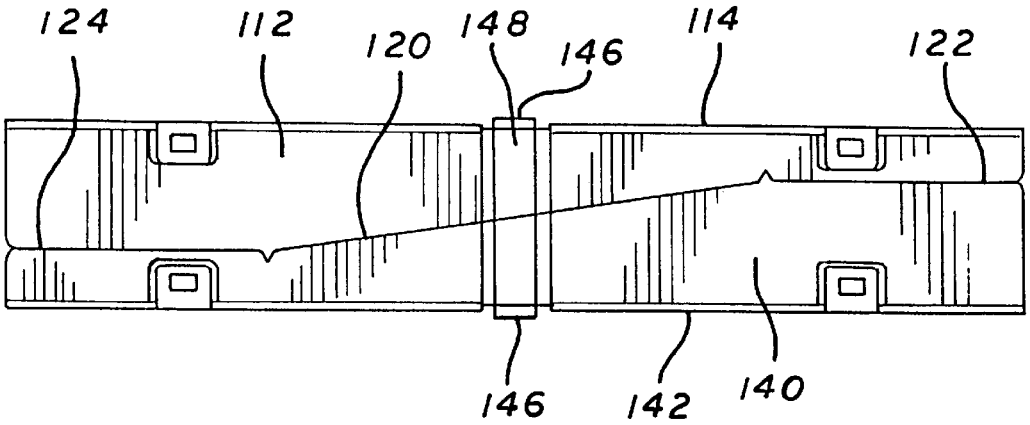
FIG. 8

PROTECTIVE SHIPPING CONTAINER FOR FLOWERS

CROSS-REFERENCE TO RELATED APPLICATION

This application is a continuation-in-part of Ser. No. 09/272,187 filed Mar. 18, 1999, now U.S. Pat. No. 6,039, 180.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a protective shipping container for flowers, such as roses or tulips. Flowers, such as roses, are grown in areas far removed from the population centers and markets which they serve. Hence, the provisions for shipping of such flowers is an important aspect of the economics of the flower business, and an inexpensive, lightweight, but highly protective shipping container is an optimum requirement.

BRIEF SUMMARY OF THE INVENTION

A closeable shipping container for containment of a plurality of flowers with stems which includes separated protective bud-containing housings and/or separate stem supporting means. The container is made of plastic, or other lightweight, but strong materials. The container is dimensioned so that the volume it occupies, per dozen flowers, is most economical to ship. The container may be configured such that the lid compartment and base compartment are identical.

BRIEF DESCRIPTION OF THE DRAWINGS

FIG. 2 is a perspective view of FIG. 1 in closed condition;

FIG. 3 is an elevational end view of FIG. 2, as viewed along the direction of arrow A of FIG. 2;

FIG. 4 is a side elevational view of FIG. 2, as viewed along the direction of arrow B of FIG. 2;

FIG. 6 is an end elevational view of the embodiment of FIG. 5 in closed condition, as seen from the right end of FIG. 5;

FIG. 7 is a cross-sectional view taken along line 7—7 of FIG. 6; and FIG. 8 is a side elevational view of FIG. 5 taken in the direction of arrow C of FIG. 5.

DETAILED DESCRIPTION OF THE DRAWINGS

Figure 1:
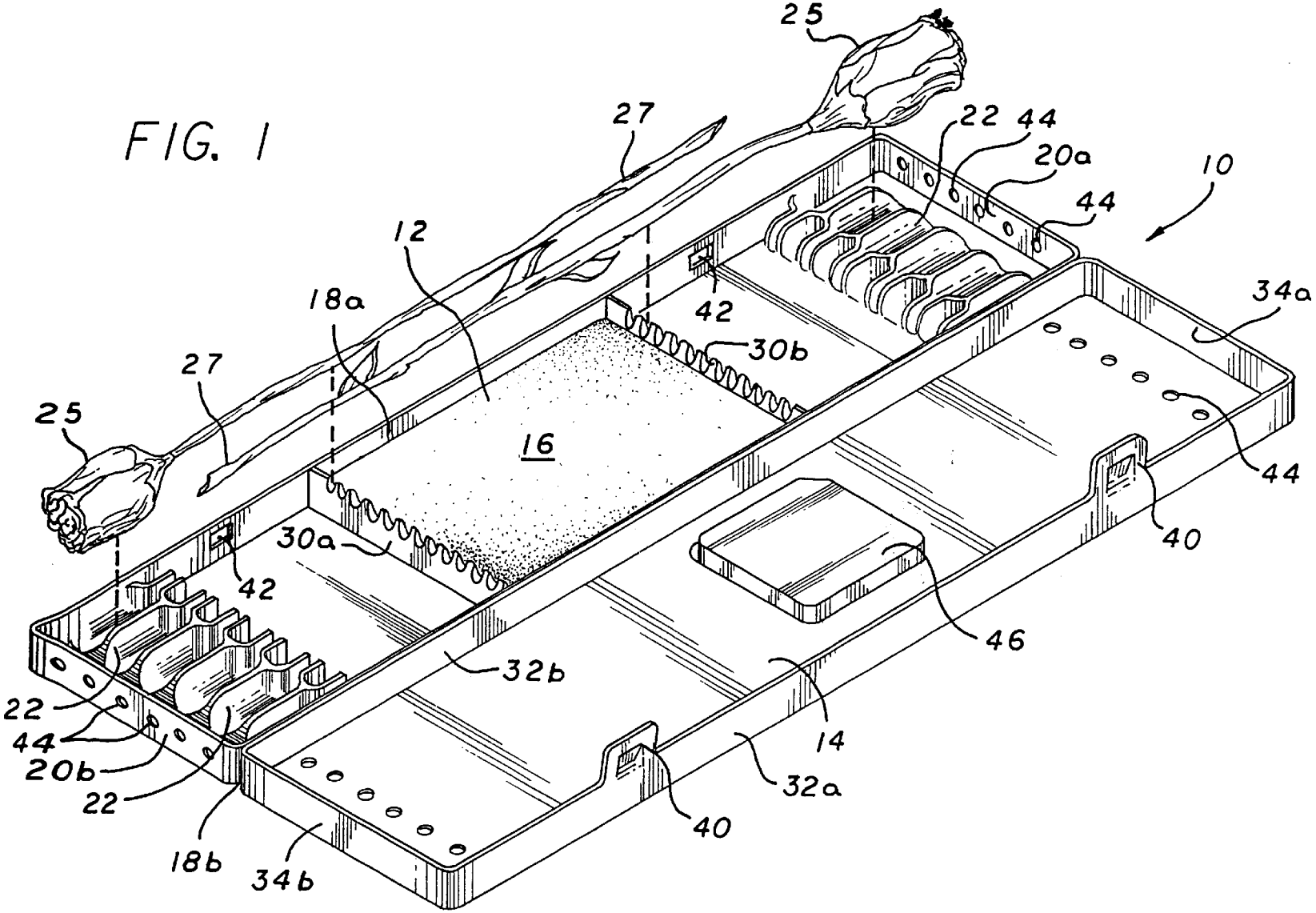
FIG. 1 is perspective view of a first preferred embodiment of my invention showing the interior of the closeable container in open condition.
Figure 5:
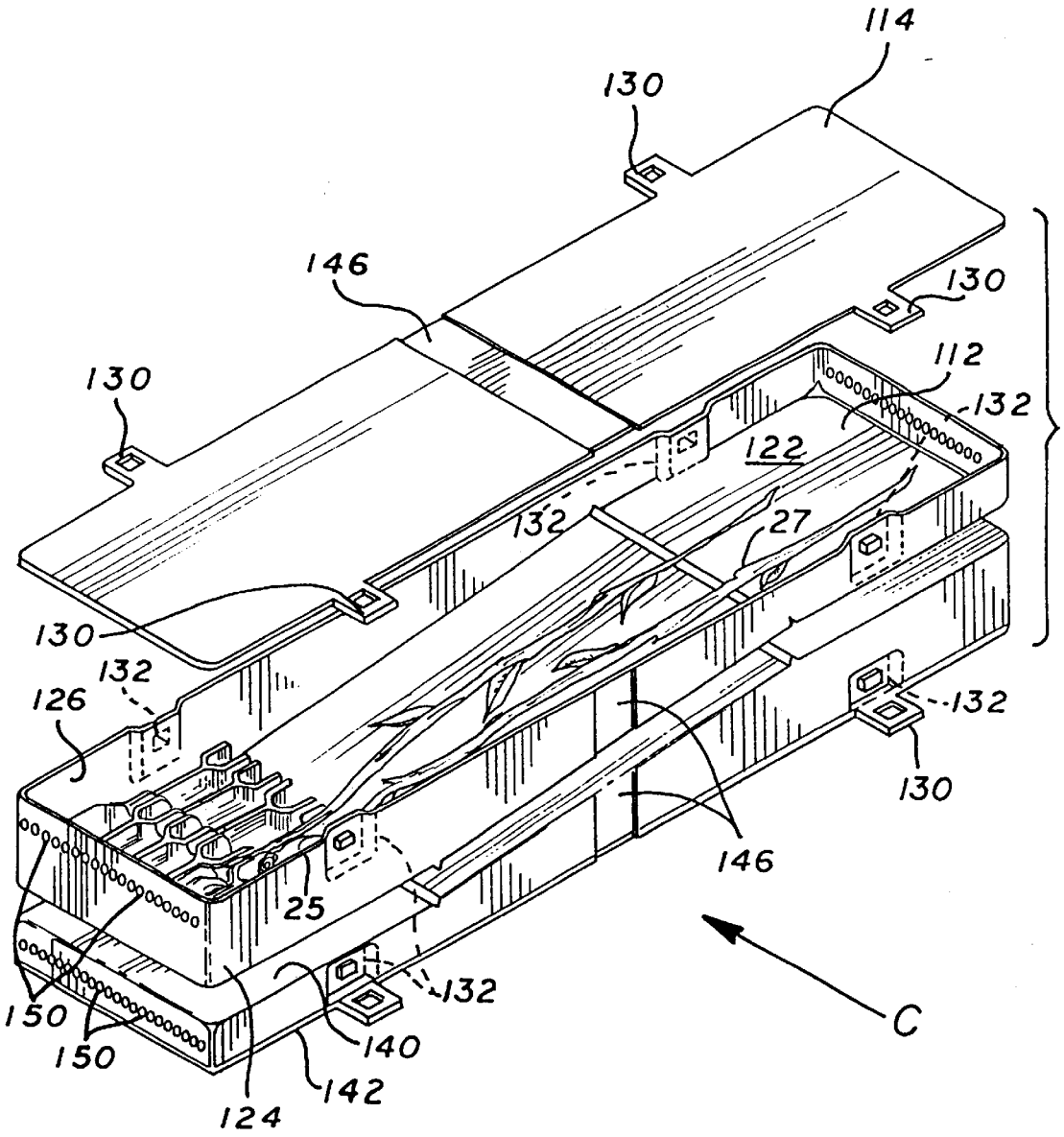
FIG. 5 is an exploded perspective view of a second preferred embodiment of my invention.

The first preferred embodiment of shipping container 10 of my invention, shown in FIG. 1 comprises two elongated compartments 12 and 14, preferably hinged together along the right side wall (see also FIG. 2). Compartment 12 is the base compartment and comprises a flat horizontal floor 16 bounded by upstanding side walls 18*a*, 18*b*, and end walls 20*a*, 20*b*. At either end of base compartment 12 there is provided preferably six separate bud-conforming housings 22, each sized to contain one bud of a flower, e.g. a rose bud 25 whereby six rose buds may be laid within the six bud-conforming housings 22 and their stems 27 laid lengthwise within the base compartment 12, each stem 27 being supported intermediate its ends within notched bridging or support members 30*a*, 30*b*. The manner in which flowers, such as roses, are stably encapsulated within the bud-conforming housings 22 is shown, schematically, in FIG. 1.

The second compartment 14, designated as the lid compartment, also includes upstanding side walls 32*a*, 32*b*, and end walls 34*a*, 34*b*, and is hingeably engaged to the base compartment 12 at sidewall 18*b*. Compartment 14 is closeably engaged with the base compartment 12 by means of fasteners such as tongue and groove members 40, 42. The fastening members 40, 42 are flush with the side walls of the container 10, when the two compartments 12, 14 are closed, as shown in FIG. 3.

Openings 44 are provided at the ends of the container 10 preferably in both compartments 12 and 14 for venting of gases and air communication. Preferably, these openings are small and numerous so as to allow the venting of gasses from the flowers, while still isolating the flowers from unfavorable conditions. In the lid compartment 14, an indented area 46 is provided intermediate its ends 34*a*, 34*b* for affixation of identification indicia.

The compartments 12, 14 the bud-conforming housings 22, the support members 30*a*, 30*b*, and all other components comprising the shipping container 10 are preferably made of conventional moldable plastic materials such as expanded polystyrene foam. Other lightweight conventional plastic materials, such polyethylene terepthalate, may also be used. The container 10 and all of its components parts are preferably integrally molded into a single unit. Container 10, which contains a dozen roses by way of example only, is preferably dimensioned as follows:

Width—10½";

Length—30½"; and

Depth—1⅞"

In the second embodiment of the invention, a base compartment 112 is provided with an intermediate sloping floor portion 120 extending between upper and lower horizontal end portions 122, 124, respectively (See FIGS. 5–8 and FIGS. 5 and 6 in particular). Thus, the interior of the base compartment 112 is provided with a greater depth at the lower horizontal end portion of the base compartment, designated by the numeral 126, to thereby accommodate buds 25 (show in dotted line) within a plurality (e.g. twelve) of separate bud-conforming housings 128 whereas the stems 130 (also shown in dotted line) extend upwardly along, and in contact with, the intermediate sloping floor portion 120, terminating in the upper shallower end 122 of the base compartment 112. The base compartment 112 is closeable by lid panel 114 by conventional fastener means, e.g. by tongue and groove members 130, 132. The resulting closed base/lid container 112, 114 comprises a first container module.

In this second embodiment, a second base and lid compartment 140, 142 identical to the first base and lid compartments 112, 114, comprise a second container module and is aligned with the first module 112, 114 in a manner such that the deeper end of the said first module overlies the shallow end of the second module 140, 142, and the shallow end of the first container module 112, 114 is aligned with the deeper end of the second container module, as shown in FIG. 7. The first and second container modules are then physically bound to each other along slightly indented intermediate area 146 by adhesive means 148 elastic or other binding means.

The resultant first and second modules 112, 114 and 140,142, when thus aligned, form in geometric terms, a three-dimensional solid having six rectangular surfaces or faces, i.e., a rectangular solid which is an optimum shape for shipping. FIGS. 5–8 illustrate the two modules, each of which contains one dozen roses or other flowers, carefully protected and nestled within their separate bud-conforming housings, the housings being arranged in two rows of six each, the rows extending across the width of the base compartment. The first and second modules 112, 114 and 140, 142 when aligned as shown in FIGS. 5–8 and physically bound are preferably dimensioned as follows:

Width—10½";

Length—30½; and

Depth—2 13/16"

The base compartments 112 and 140 of each module are preferably integrally formed from moldable plastic materials, as described with reference to the first embodiment, FIGS. 1–4. Openings 150 are provided in the base compartments 112, 140 for venting of gases and air communication.

Figure 9:
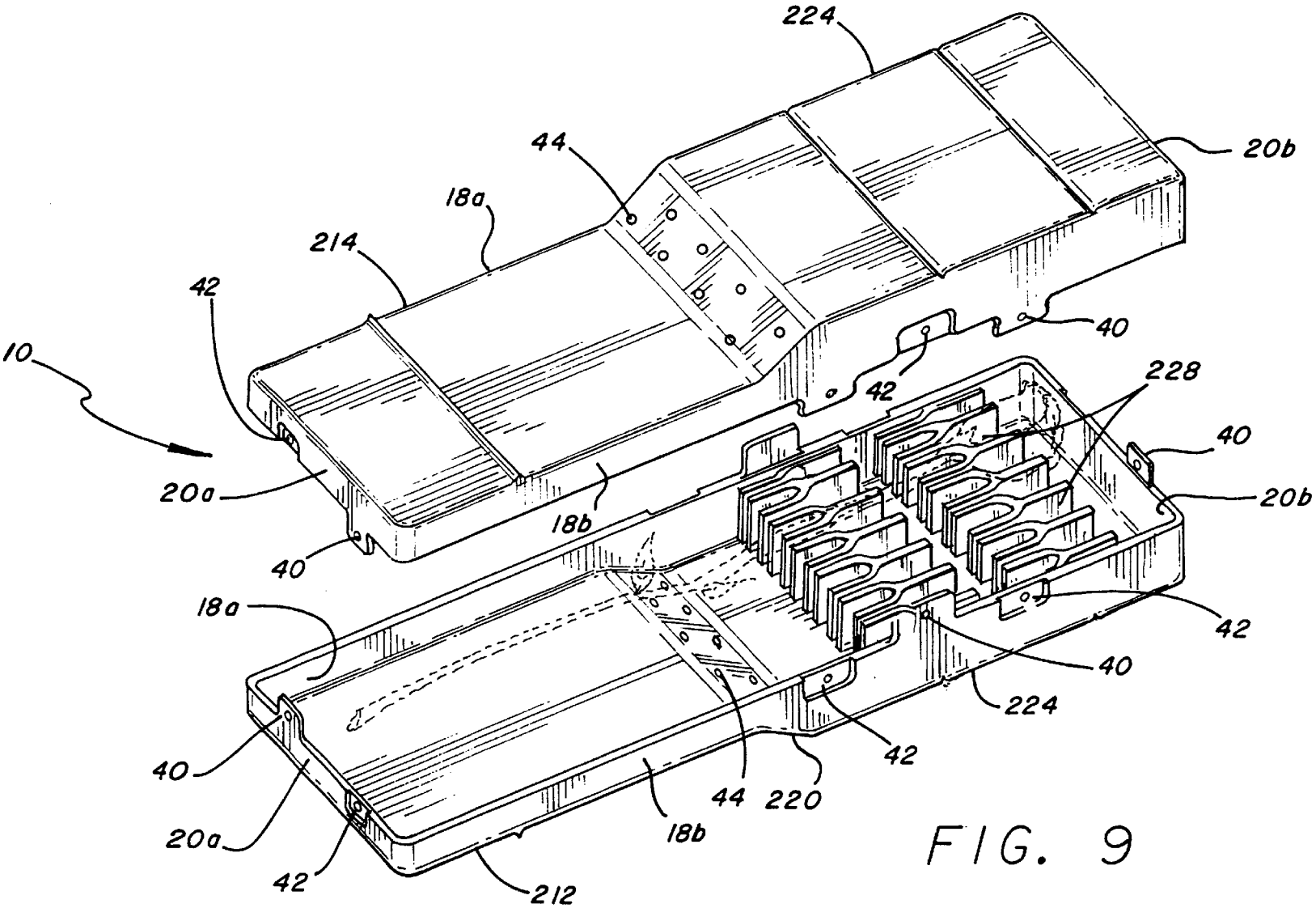
FIG. 9 is an exploded perspective view of a third preferred embodiment of my invention.

In the third preferred embodiment of shipping container 10 of my invention, shown in FIG. 9 the two elongated compartments 212 and 214 are identical. The base compartment 212 is symmetrical except for opposed tongue and groove members 40, 42. Thus, when a base compartment 212 is turned over, it comprises the lid compartment 214. The opposed tongue and groove members 40 and 42 on the base compartment 212 and lid compartment 214 may then be closeably engaged.

The third preferred embodiment may contain an intermediate sloping floor portion 220 extending between upper and lower horizontal end portions 222, 224 respectively. Thus, when the base compartment 212 is closeably engaged with the lid compartment 214, the interior of the shipping container 10 is provided with a greater depth at the opposed lower horizontal ends portions 224 of the two compartments. This greater depth accommodates the buds 25 within a plurality (e.g. twelve) of separate bud-conforming housings 228. Preferably, the bud-conforming housings 228 of this third preferred embodiment differs from the bud-conforming housings of the other embodiments in that they are formed in-part by the base compartment 212 and in-part by the lid compartment 214. The plurality of bud conforming housings 228 may be formed in the preferable configurations of two rows of six (FIG. 9) or three rows of four (not shown).

Figure 10:
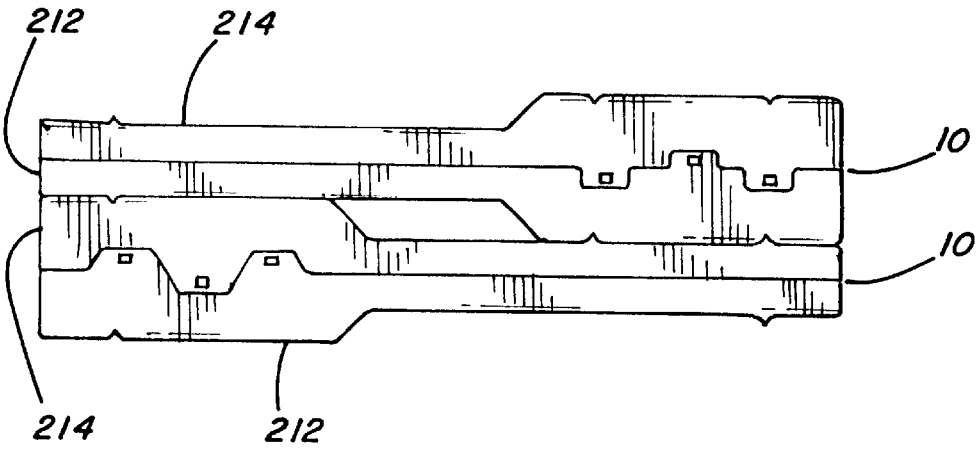
FIG. 10 is a side elevational view of FIG. 9 in a closed stacked condition.

When closeably engaged, the base compartment 212 and lid compartment 214 form a first container module. A second container module, composed of a base compartment 212 and a lid compartment 214, may be aligned with and stacked with the first container module. This is depicted in FIG. 10 and is basically similar to the arrangement of the stacked modules of the second preferred embodiment. In this third preferred embodiment, a third or more container modules may be aligned with and stacked with the first and second container modules. A single container module is preferably dimensioned as follows:

Width—10 inches

Length—30 inches

Depth shallow end—1 inch

Depth deep end—2 inches

The compartments 212, 214 of the third preferred embodiment are preferably made of conventional module plastic materials such as expanded polystyrene foam. One advantage of this third embodiment is that the base compartment 212, and the lid compartment 214 being identical, may be formed from a single mold. This reduces the cost and complexity of manufacturing the shipping container 10.

Figure 11:
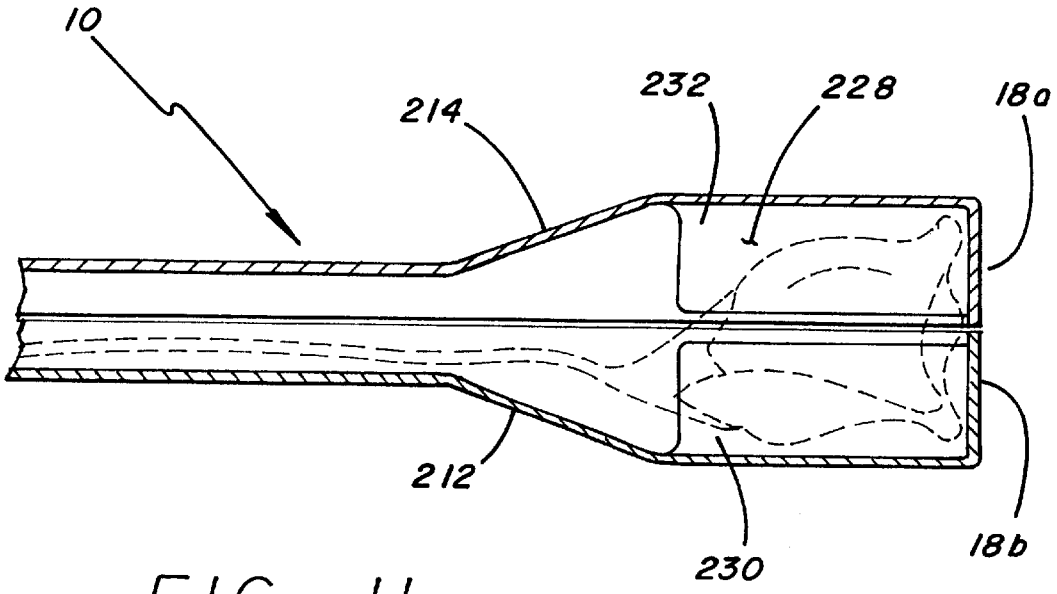
FIG. 11 is a partial cut-away side view of the third preferred embodiment of my invention.

The base compartment 212 and lid compartment 214 may each provide a portion of the bud conforming housing 228. FIG. 11 depicts a portion of the shipping container 10 in the third preferred embodiment having a base portion 230 of the bud conforming housing formed within the base compartment 212 and a lid portion 232 of the bud conforming housing formed within the lid compartment 214. When the two compartments are closed, the base portion and the lid portion come together to form a bud conforming housing which surrounds and stably encapsulates the buds.

Modification of the foregoing embodiments may be suggested by those ordinarily skilled in the art, hence; I intend to be bound only by the claims, which follow.

I claim:

1. A protective shipping container for flowers having buds and stems which comprises:

a first elongate compartment having a floor extending between upstanding opposed sidewalls and upstanding opposed end walls;

a first plurality of individual housings disposed within said first elongate compartment;

a second elongate compartment having a floor extending between upstanding opposed sidewalls and upstanding opposed end walls;

a second plurality of individual housings disposed within said second elongate compartment;

fastening means affixing said first elongate compartment to said second elongate compartment such that the first plurality of individual housings engage the second plurality of individual housings to stably encapsulate the buds of the flowers.

2. The protective shipping container of claim 1, wherein the first elongate compartment and the second elongate compartment are connected by at least one hinge.

3. The protective shipping container of claim 1, wherein the fastening means include tongue and groove members.

4. The protective shipping container of claim 1, wherein the protective shipping container is configured to hold at least twelve flowers with the buds of each flower oriented in the same direction.

5. A protective shipping container for flowers having buds and stems which comprises:

a pair of identical elongate compartments, each having a floor extending between opposed sidewalls and upstanding opposed end walls, the elongate compartments being made of a moldable plastic material, and being made from the same mold;

a plurality of individual housings disposed within said elongate compartments, each of the housings being of such a size and shape as to stably encapsulate each of the buds of the flowers; and fastening means affixing one elongate compartment to the other to form a closed container wherein the elongate compartments form an interior space.

6. A protective shipping container for flowers having buds and stems which comprises:

a pair of identical elongate compartments, each having a floor extending between opposed sidewalls and upstanding opposed end walls;

a plurality of individual housings disposed within the elongate compartments, each of the housings being of such a size and shape as to stably encapsulate each of the buds of the flowers and wherein the portion of the individual housings disposed within each elongated compartment is configured to be of one-half the size required to stably encapsulate the buds of the flowers; and fastening means affixing one elongate compartment to the other to form a closed container wherein the elongate compartments form an interior space.

* * * * *